US007222855B2

(12) United States Patent
Sorge

(10) Patent No.: US 7,222,855 B2
(45) Date of Patent: May 29, 2007

(54) POKER BLACKJACK GAME

(76) Inventor: Nicholas Sorge, 7 Susan Ct., Deer Park, NY (US) 11729

( * ) Notice: Subject to any disclaimer, the term of this patent is extended or adjusted under 35 U.S.C. 154(b) by 0 days.

(21) Appl. No.: 10/949,989

(22) Filed: Sep. 24, 2004

(65) Prior Publication Data

US 2006/0066050 A1 Mar. 30, 2006

(51) Int. Cl.
*A63F 1/00* (2006.01)

(52) U.S. Cl. ..... 273/292; 273/274

(58) Field of Classification Search ..... 273/292, 273/274

See application file for complete search history.

(56) References Cited

U.S. PATENT DOCUMENTS 4,861,041 A 8/1989 Jones et al.
5,529,309 A 6/1996 Bartlett
5,632,485 A 5/1997 Woodland et al.
5,636,838 A 6/1997 Caro
5,636,843 A 6/1997 Roberts
5,702,106 A 12/1997 Alvarez, Jr.
5,743,532 A 4/1998 Lafferty
5,836,586 A 11/1998 Marks et al.
5,839,730 A 11/1998 Pike
5,863,042 A 1/1999 Lo
5,934,675 A 8/1999 Handelman et al.
5,975,529 A * 11/1999 de Keller ..... 273/292
5,979,897 A 11/1999 Grossman
5,984,308 A 11/1999 Herrmann
6,000,699 A 12/1999 Long
6,012,719 A 1/2000 Webb
6,062,564 A 5/2000 Terminel
6,095,525 A 8/2000 Terminel
6,113,102 A 9/2000 Marks et al.
6,158,741 A 12/2000 Koelling
6,206,375 B1 3/2001 Wichinsky
6,341,778 B1 1/2002 Lee
6,371,867 B1 4/2002 Webb
6,386,973 B1 * 5/2002 Yoseloff ..... 463/13
6,394,456 B1 5/2002 Long
6,422,565 B1 * 7/2002 Daines ..... 273/292
6,450,500 B1 9/2002 Miller
6,481,717 B1 11/2002 Richardelle
6,481,718 B2 11/2002 Koelling
6,481,719 B2 11/2002 Webb
6,485,020 B1 11/2002 Broadnax
6,511,070 B1 * 1/2003 Daines ..... 273/292
6,523,831 B2 2/2003 Webb (Continued)

OTHER PUBLICATIONS

Pamphlet: "Table Games", by Shuffle Master™ Inc., Las Vegas, NV 2004 (copy enclosed).

*Primary Examiner*—Eugene Kim
*Assistant Examiner*—Dolores R. Collins
(74) *Attorney, Agent, or Firm*—Scully, Scott, Murphy & Presser, P.C.

(57) ABSTRACT

A method for playing a modified blackjack game between a dealer and at least one player. Each player places a first wager, the outcome of which is determined by conventional rules of blackjack play. Players may optionally place an additional wager or side bet corresponding to a five-card poker hand made up of two cards dealt to the player and three community cards. A predetermined multiple of an amount of the additional wager is paid out or collected based on the rank of the poker hand. Players may also place additional wagers corresponding to a predicted color of their initial two card hand.

5 Claims, 2 Drawing Sheets

U.S. PATENT DOCUMENTS 6,536,767 B1 3/2003 Keller
6,543,773 B2 4/2003 Mims
6,575,464 B1 * 6/2003 Fertitta et al. ..... 273/274
6,585,588 B2 7/2003 Hartl
6,659,461 B2 12/2003 Yoseloff et al.
6,692,003 B2 2/2004 Potter et al.
6,719,291 B1 * 4/2004 deKeller ..... 273/274
6,749,200 B2 * 6/2004 Yurkins ..... 273/292
6,773,013 B2 8/2004 Caldwell
6,776,416 B1 * 8/2004 Jackson ..... 273/292
6,808,173 B2 * 10/2004 Snow ..... 273/292
6,845,981 B1 1/2005 Ko
6,854,731 B2 2/2005 Saucier
6,854,733 B2 2/2005 Webb
6,863,274 B2 3/2005 Webb
6,874,786 B2 * 4/2005 Bruno et al. ..... 273/306
6,877,746 B1 * 4/2005 Herren et al. ..... 273/292
6,896,265 B1 * 5/2005 Schlumbrecht ..... 273/292
6,896,266 B1 5/2005 Terminel
6,902,167 B2 6/2005 Webb
6,916,245 B1 * 7/2005 Vancura et al. ..... 463/26
2001/0015529 A1 8/2001 Allen
2001/0035607 A1 11/2001 Moore
2002/0027322 A1 * 3/2002 Breeding et al. ..... 273/292
2002/0036382 A1 3/2002 Brunelle
2002/0190467 A1 * 12/2002 Braun ..... 273/274
2003/0057648 A1 3/2003 Webb
2003/0155715 A1 8/2003 Walker et al.
2003/0207706 A1 11/2003 Potter et al.
2003/0218303 A1 11/2003 Walker et al.
2003/0222400 A1 12/2003 Collins et al.
2004/0124585 A1 * 7/2004 Daines ..... 273/292
2004/0132519 A1 7/2004 Holm
2004/0195770 A1 10/2004 Ornstein
2004/0227294 A1 11/2004 Au-Yeung
2005/0029743 A1 * 2/2005 Daines ..... 273/292
2005/0035548 A1 * 2/2005 Yoseloff et al. ..... 273/274
2005/0040601 A1 * 2/2005 Yoseloff et al. ..... 273/292
2005/0073100 A1 4/2005 Falciglia, Sr.
2005/0073102 A1 * 4/2005 Yoseloff et al. ..... 273/292
2005/0082760 A1 * 4/2005 Yoseloff et al. ..... 273/292
2005/0085287 A1 * 4/2005 Sines ..... 463/13
2005/0116414 A1 * 6/2005 Yurkins ..... 273/274
2005/0121854 A1 6/2005 Webb
2005/0242506 A1 * 11/2005 Yoseloff ..... 273/292
2005/0253338 A1 * 11/2005 Daines ..... 273/292

* cited by examiner

POKER BLACKJACK GAME

BACKGROUND OF THE INVENTION

1. Field of the Invention

The invention relates generally to the field of casino gaming. More particularly, the invention relates to variations or modifications of the card game known as blackjack or twenty-one. The invention further relates to a card game which incorporates features of a poker game with blackjack or twenty-one.

2. The Prior Art

Blackjack or twenty-one is a well-known casino card game. Blackjack is played with one or more standard decks of 52 playing cards. The playing cards comprise two colors: black and red, and four suits: spades, clubs, hearts and diamonds. The suits of spades and clubs are typically black in color and the suits of hearts and diamonds are typically red in color. Each numbered card (2, 3, 4, 5, 6, 7, 8, 9 and 10) is assigned a point value equal to its number. Face cards (kings, queens, and jacks)are assigned a point value of ten. Aces are assigned a point value of either one or eleven at the discretion of a player holding a hand which includes an ace.

Blackjack is typically played on a table having a straight edge behind which a dealer stands and a semi-circular edge around which one or more players are positioned. The maximum number of players at a table may be, for example, six. The blackjack table may have a top surface covered with felt or another material which is imprinted with various indicia. These various indicia may include text describing basic and house rules of play and may indicate areas where players' cards are to be dealt and where players' bets are to be placed.

The object of blackjack is for a player to accumulate a hand of cards which has a point total exceeding that of the blackjack dealer, without exceeding twenty-one. Numbered cards have a point value which equals their number value. Face cards (kings, queens, and jacks) are assigned a point value of ten and aces are assigned a point value of either one or eleven as determined by the person holding the hand including one or more aces. A two-card hand having a point total of twenty-one is known as blackjack.

Blackjack play is commenced by a player making an initial wager or bet on the outcome of the upcoming hand. An amount of this initial bet, also known as an ante, may be regulated between a minimum and maximum amount set by the casino or house for the particular table of play. Players typically indicate their bet or wager by placing an appropriate number of chips or markers, each of which has a designated value or values assigned to it, in a designated area of the blackjack table.

Following the placing of bets or wagers, the dealer deals cards to each player and to himself or herself. Each player and the dealer are initially dealt two cards. Each of the players' cards is dealt face up. The dealer's initial two cards are typically dealt one face up and one face down. The dealer generally deals one card to each player in turn, starting from the dealer's left and proceeding to the dealer's right. The dealer then deals a card to himself or herself and proceeds to deal a second card to each player, again moving from left to right and to himself or herself.

After the dealer and the players have been dealt an initial hand of two cards, each player in turn elects to receive one or more additional cards ("hit") or to take no additional cards ("stand"). A player may elect to take additional cards until they decide to stand or until the point total of the player's hand exceeds twenty-one, known as "busting." Once all players have either received their desired number of cards or have busted, the dealer elects to take additional cards or to stand. Under most rules, a dealer is not permitted to receive additional cards if the dealer's existing hand has a total point value of seventeen or greater and a dealer is required to take an additional card if the dealer's existing hand has a point total of less than seventeen.

Once all of the players and the dealer have either received a desired number of cards or have busted, the outcome of the game is determined. A player wins if either the point total for a particular hand. In either event, the winning player is paid an amount equal to his or her initial bet in addition to receiving his or her initial bet back. If the dealer's hand exceeds that of a player's or if a player busts, that player loses and forfeits his or her bet. If a dealer's point total for a hand equals that of a player, a tie or push is declared and that player receives his or her initial bet back.

Poker is another well-known card game played with one or more standard decks of playing cards. A poker hand may comprise five cards held by a player. A poker hand is assigned a particular rank or category based on the cards making up the hand. The poker hand ranks are arranged in a hierarchical order such that a player with the highest ranking hand in a round wins that round.

Typical poker hand ranks or categories, listed in order from highest to lowest rank include a royal flush, a straight flush, four of a kind, a full house, a flush, a straight, three of a kind, two pair, and one pair. A royal flush may be a five card hand consisting of an ace, a king, a queen, a jack, and a ten all of the same suit. A straight flush may be a five card hand consisting of five cards of the same suit in sequence. For example a hand consisting of a jack of clubs, a ten of clubs, a nine of clubs, an eight of clubs and a seven of clubs would be ranked as a straight flush.

Four of a kind may be a five card hand including four cards of the same rank, four example four threes. A full house may be a five card hand consisting of three cards of one rank and two cards of another rank, for example three kings and two sixes. A flush may be a five card hand consisting of five cards of the same suit. A straight may be a five card hand consisting of five cards of various suits in sequence. For example, a hand consisting of a ten of clubs, a nine of hearts, an eight of diamonds, a seven of spades and a six of diamonds would be ranked as a straight.

Three of a kind may be a five card hand including three cards of the same rank, for example three queens. Two pair may be a five card hand including two cards of one rank and two cards of another rank, for example two jacks and two sevens. A pair may be a five card hand including two cards of the same rank, for example two fours.

A five card hand which does not form a combination indicated above may be known as nothing or a may be ranked according to a highest card in the hand.

The conventional game of blackjack described above has been supplemented with a number of alternative betting procedures, including insurance, doubling down, and splitting pairs. Additionally, various methods or procedures relating to variations on or modifications of a conventional blackjack or poker game are disclosed in the following references, the disclosure of which is hereby incorporated by reference: U.S. Pat. No. 4,861,041 to Jones et al.; U.S. Pat. No. 5,836,586 to Marks et al.; U.S. Pat. No. 5,863,042 to Lo; U.S. Pat. No. 5,934,675 to Handelman et al.; U.S. Pat. No. 6,113,102 to Marks et al.; U.S. Pat. No. 6,394,456 to Long; U.S. Pat. No. 6,450,500 to Miller; U.S. Pat. No. 6,485,020 to Broadnax; U.S. Pat. No. 6,536,767 to Keller; U.S. Pat. No. 6,692,003 to Potter et al.; and U.S. Patent Publication Nos. 2003/0222400 to Collins et al.; 2003/0218303 to Walker et al.; and 2003/0057648 to Webb.

SUMMARY OF THE INVENTION

The invention relates generally to the field of casino gaming. More particularly, the invention relates to variations or modifications of the card game known as blackjack or twenty-one. The invention further relates to a card game which incorporates features of a poker game with blackjack or twenty-one.

In a method according to an embodiment of the invention, a modified blackjack game is played between at least one player and a dealer using a standard deck of playing cards. Each player places a first wager in order to become eligible to participate in the blackjack game. The outcome of the first wager is determined in accordance with conventional rules of a blackjack play and is dependant upon the final hands of cards drawn by the dealer and the individual player placing the first wager.

An additional wager zone is provided in a vicinity of each player. Each player may optionally place an additional wager or side bet by placing one or more wagering devices in the additional wager zone associated with the player placing the additional wager. The additional wager corresponds to a five-card poker hand comprising an initial hand of two cards dealt to the player placing the additional wager and three cards dealt as community cards. A first card is dealt to each player and the dealer and a second card is dealt to each player. Three community cards, which may be dealt face up in a central location, are dealt.

A rank of the five-card hand dealt to each player electing to place an additional wager is determined. For example, the five-card hand may be categorized as a royal flush, a straight flush, four of a kind, a full house, a flush, a straight, three of a kind, two pair or no hand. A predetermined multiple of the amount of the additional wager is paid out or collected based on the rank of the five-card poker hand. A second card is dealt to the dealer and the blackjack game is complete according to conventional rules of blackjack play.

In a method according to another embodiment of the invention, a modified blackjack game is played between at least one player and a dealer using a standard deck of playing cards. Each player places a first wager in order to become eligible to participate in the blackjack game. The outcome of the first wager is determined in accordance with conventional rules of a blackjack play and is dependant upon the final hands of cards drawn by the dealer and the individual player placing the first wager.

A first additional wager zone indicating a fist color, for example black, is provided in a vicinity of each player. A second additional wager zone indicating a second color, for example red, is provided in a vicinity of each player. A third additional wager zone is also disposed in a vicinity of each player.

Each player may optionally place a first additional wager or side bet by placing one or more wagering devices in the first or second additional wager zone associated with the player placing the first additional wager and corresponding to a predicted color of an initial hand of two cards dealt to the player. Each player may optionally place a second additional wager or side bet by placing one or more wagering devices in the third additional wager zone associated with the player placing the second additional wager. The third additional wager corresponds to a five-card poker hand comprising the initial hand of two cards dealt to the player and three cards dealt as community cards. A first card is dealt to each player and the dealer and a second card is dealt to each player. Three community cards, which may be dealt face up in a central location, are dealt.

A color of a first card and a second card dealt to each player electing to place a first additional wager is determined and a rank of the five-card poker hand of each player electing to place a third additional wager is determined.

An amount of the first additional wager is collected if the first card and second card dealt to the player placing the first additional wager are not the same color or if the first card and the second card are the same color but are not the predicted color. A predetermined multiple of an amount of the first additional wager is paid to the player placing the first additional wager if the first card and second card dealt to the player are the same color and the color is the predicted color. A higher predetermined multiple may be paid out if the first card and second card dealt to the player placing a first additional wager are the same color and suit and the color is the predicted color.

A predetermined multiple of the amount of the second additional wager is paid out or collected based on the rank of the five-card poker hand. A second card is dealt to the dealer and the blackjack game is completed according to conventional rules of blackjack play.

An advantage of a modified blackjack game according to an embodiment of the invention is that a blackjack player is given an option to place an additional wager or side bet corresponding to a five-card poker hand comprising an initial hand of two cards dealt to the player and three community cards, wherein the option to place an additional wager increases player interest and casino revenue. A game according to an embodiment of the invention may be based on any blackjack or twenty-one game.

Other advantages of a modified blackjack game according to an embodiment of the invention are that the modified game is simple to learn and play and that the outcome of an additional wager or side bet may be independent of an outcome of a first wager, thereby providing a player with increased possibilities for winning in a particular game. A further advantage of a modified blackjack game according to an embodiment of the invention is that the provision of a five-card poker hand allows for a variety of ranks of poker hands and a corresponding variety of predetermined payout ratios.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements.

DETAILED DESCRIPTION OF THE PREFERRED EMBODIMENTS

Figure 1:
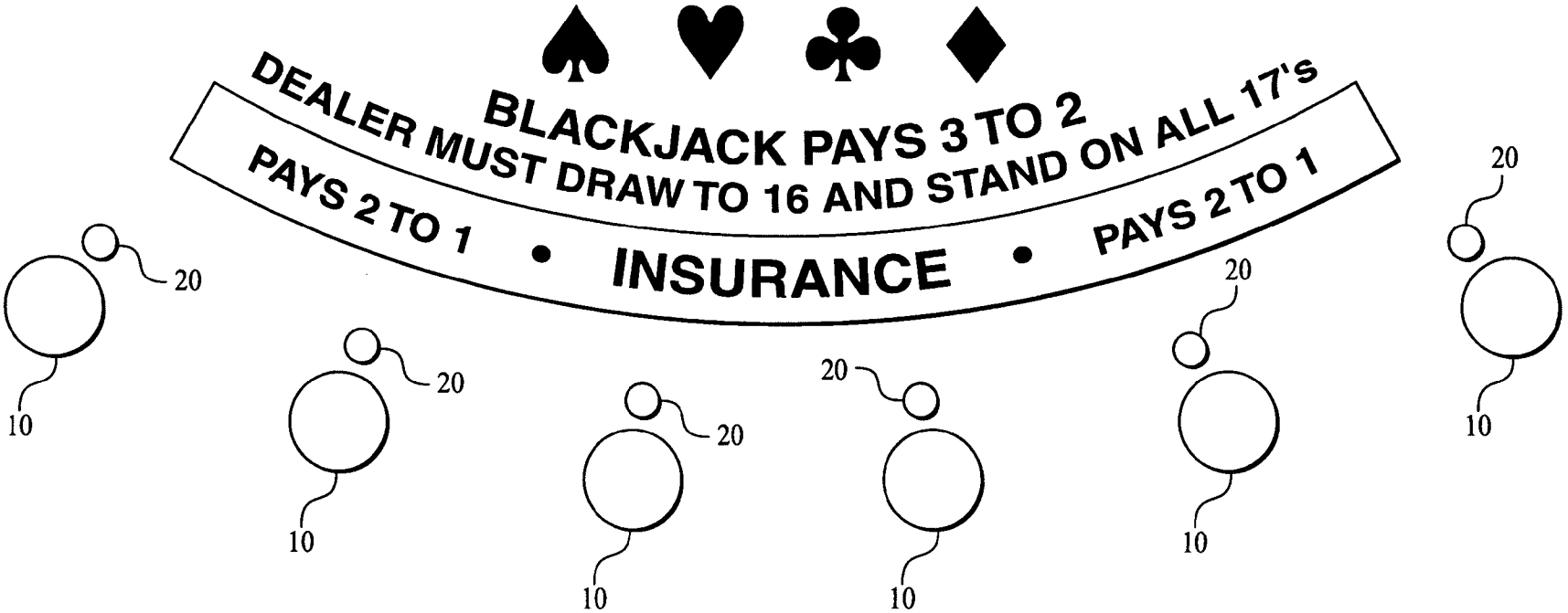
FIG. 1 shows a top view of a playing surface which can be used to play a modified blackjack game according to an embodiment of the invention.

Referring now in detail to the drawings, FIG. 1 shows a top view of a top surface of a blackjack table which can be used to play a modified blackjack game according to an embodiment of the invention.

One or more players, for example six players, sit or stand adjacent to a front, semi-circular portion of a blackjack table. A dealer is positioned behind a back edge of the table, facing the one or more players.

One or more first wager locations or zones 10 are provided for players to make a first wager in order to be eligible to participate in a particular game or round of play. A player may indicate a first wager by placing one or more chips, markers, or other wagering devices in a first wager location 10 associated with that player. Each chip or marker may have a predetermined value. The amount of a first wager which a player may make for a particular game or table may be regulated between certain maximum and minimum values by a casino or other authority. An outcome of each player's first wager is determined at the conclusion of a particular game in accordance with conventional rules of blackjack play by comparing a player's final hand total point value to a dealer's final hand total point value.

One or more additional wager locations or zones 20 are provided for players to make an additional wager which corresponds to a five-card poker hand comprising an initial hand of two cards dealt to a player making an additional wager and three common community cards. The placing of an additional wager may be optional, and a player may elect not to place an additional wager in a particular game or round of play and still participate in that particular game or round of play, provided the player has made a first wager.

A player electing to make an additional wager may indicate an additional wager by placing one or more wagering devices, such as chips or markers, within an additional wager zone 20 associated with that player. The amount of an additional wager which a player may place for a particular game or table may be regulated between certain maximum and minimum values by a casino or other authority.

Following the placing of first and any additional wagers, a dealer deals a card to each player who has made a first wager in succession from left to right and a card to the dealer himself or herself. The dealer deals a second card to each player who has received a first card. Three common or community cards are dealt. Preferably, the three community cards are dealt face up and positioned in a central portion of the blackjack table with respect to all of the players and the dealer so that the community cards may be easily viewed by the dealer and players.

Cards may be dealt from one or more standard decks of 52 cards, preferably from a single standard deck. An automatic card shuffler may be used for shuffling the deck.

After a player electing to make an additional bet has received a second card, and the three community cards have been dealt, a rank of a five-card poker hand comprising the two cards dealt to the player and the three community cards is determined. For example the five-card poker hand may comprise a royal flush (an ace, king, queen, jack and ten all in the same suit), a straight flush (five cards of the same suit in sequence), four of a kind, a full house (three of a kind and a pair), a flush (five cards of the same suit), a straight (five cards in sequence), three of a kind, two pair or a single pair.

A predetermined multiple of an amount of the additional wager is collected from the player placing the additional wager or paid to the player placing the additional wager based on the rank of that player's five-card poker hand. Generally, the higher the rank of the five-card poker hand achieved by the player, the greater the predetermined multiple or payout ratio. For example, a five-card poker hand comprising a royal flush may pay out at a ratio of 5000:1, a straight flush at a ratio of 1000:1, four of a kind at a ratio of 100:1, a full house at a ratio of 75:1, a flush at a ratio of 50:1, a straight at a ratio of 25:1, three of a kind at a ratio of 10:1, and two pairs at a ratio of 5:1.

Additionally a five card poker hand comprising a single pair or lower may pay at a ratio of −1:1. In other words, a player making an additional wager based on a rank of the five-card poker hand comprising an initial hand of two cards dealt to the player and three community cards, who achieves a five-card poker hand of a pair or nothing may forfeit an amount of that player's additional wager which may be collected by the dealer or house.

The payout ratios listed above are exemplary only and may be adjusted by a particular casino or other authority. For example the payout ratios may be adjusted to raise or lower the "house advantage" associated with a particular embodiment of a game according to the invention.

Furthermore, a particular card pair may have one payout ratio associated with it and another card pair may have another, different payout ratio associated with it. For example, a pair of jacks, kings queens or aces ("jacks or better") may pay out at a ratio of 3:1, whereas a pair of twos, threes, fours, fives, sixes, sevens, eights, nines or tens may pay out at a ratio of −1:1.

A second card is dealt to the dealer and the game is completed according to conventional rules of blackjack play.

Figure 2:
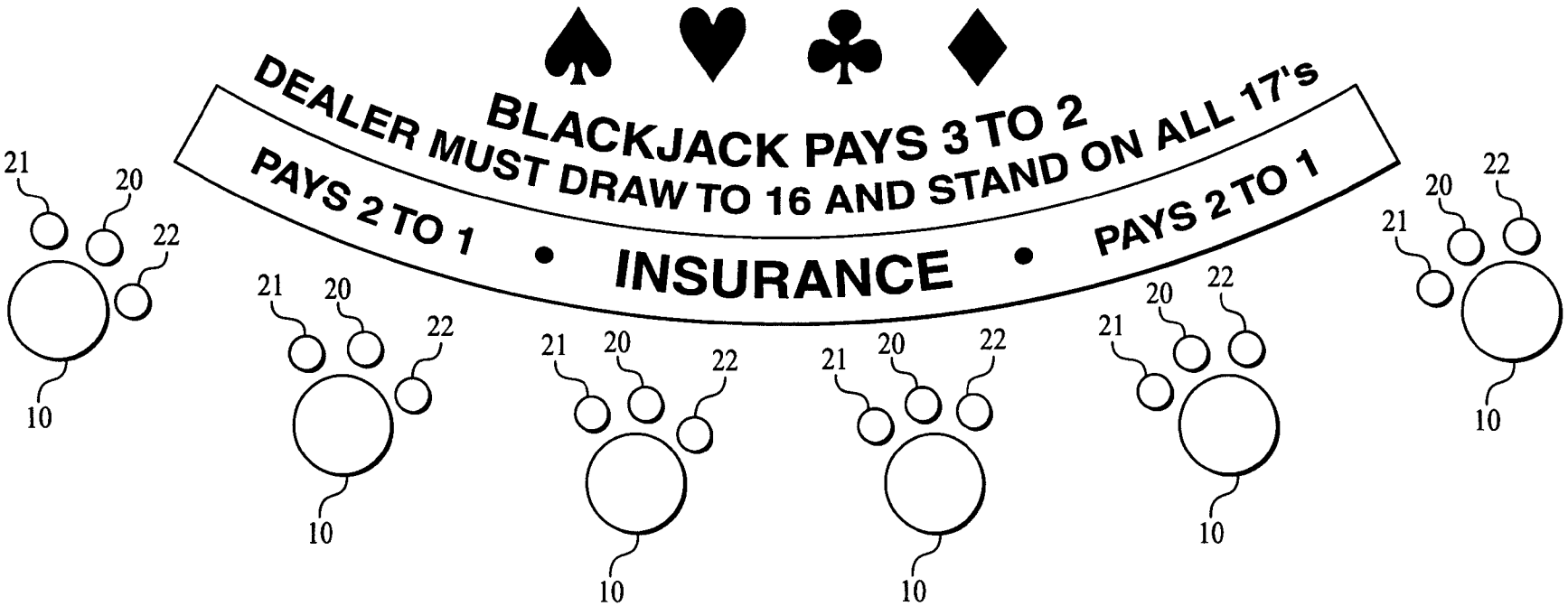
FIG. 2 shows a top view of a playing surface which can be used to play a modified blackjack game according to another embodiment of the invention.

FIG. 2 shows a top view of a top surface of a blackjack table which can be used to play a modified blackjack game according to another embodiment of the invention.

In this embodiment of the invention, a modified blackjack game is played between a dealer and at least one player as described above. However, a first additional wager zone 21 corresponding to a first color, for example black, and a second additional wager zone 22 corresponding to a second color, for example red, are provided in a vicinity of each player. First and second additional wager zones 21 and 22 may indicate a particular color by incorporating text, for example reading "BLACK" or "RED", or may display the corresponding indicated color. A third additional wager zone 20 corresponding to a five-card poker hand as described above is also provided in a vicinity of each player.

A player may place a first additional wager by placing one or more wagering devices, such as chips or markers, in one or more of the first and second additional wager zones 21, 22. A first additional wager corresponds to a predicted color of both cards of an initial hand of two cards dealt to the player placing a first additional wager.

A player may place a second additional wager by placing one or more wagering devices, such as chips or markers, in third additional wager zone 20. A third additional wager corresponds to a five-card poker hand made up of an initial two-card hand dealt to the player placing the third additional wager and three community cards.

A first card is dealt to each player and to the dealer and a second card is dealt to each player. Three common or community cards are dealt, preferably face up in a location easily visible to all players and the dealer.

A color of a first card and a second card dealt to a player placing a first additional wager is determined. A rank of the five-card poker hand dealt to a player placing a second additional wager is determined.

If a player places a first additional wager and the first card and second card dealt to that player are different colors or are the same color but not the predicted color, that player forfeits an amount of the first additional wager, which may be collected by the dealer. For example, if a player places a first additional wager by placing a wagering device on first additional wager zone 21 corresponding to black, and that player draws an initial two card hand consisting of two red cards or a black card and a red card, the player loses the first additional wager and an amount of the first additional wager may be collected by the dealer.

If a player places a first additional wager and a first card and a second card dealt to that player are a same color and that color is the predicted color, the player is paid a predetermined multiple of an amount of the first additional wager. For example, if a player placed a first additional wager by placing a wagering device on first additional wager zone 21 corresponding to black, and that player draws an initial two card hand consisting of two black cards, the player wins the first additional wager and is paid a predetermined amount of the first additional wager.

A greater predetermined multiple of an amount of the first additional wager may be paid if a player places a first additional wager and draws an initial two-card hand consisting of two cards of the same suit which correspond to the predicted color. For example, a player making a first additional wager by placing a wagering device in second additional wager zone 22 corresponding to a predicted color of red who draws a "suited" hand consisting of two hearts or two diamonds may be paid a higher predetermined multiple of an amount of the first additional wager than a player making the same wager and drawing a heart and a diamond card.

A player may place a second additional wager corresponding to a five-card poker hand by placing one or more wagering devices, such as chips or markers in third additional wager zone 20. An outcome of a third additional wager may be determined as described with respect to FIG. 1 above.

Following the settling of any first and second additional wagers, a second cad may be dealt to the dealer and the blackjack game may be completed according to conventional rules of blackjack play.

Accordingly, while several embodiments of the present invention have been shown and described, it is obvious that many changes and modifications may be made thereunto without departing from the spirit and scope of the invention.

What is claimed is:

1. A method of playing a modified blackjack game between at least one player and a dealer, using a standard deck of playing cards, the method comprising the steps of:

a) having at least one player place a first wager to participate in the blackjack game, wherein an outcome of said first wager is determined by conventional rules of blackjack play;

b) providing a first additional wager zone disposed in a vicinity of each player, wherein said first additional wager zone indicates a first color;

c) providing a second additional wager zone disposed in a vicinity of each player, wherein said second additional wager zone indicates a second color;

d) providing a third additional wager zone disposed in a vicinity of each player;

e) having at least one player place a first additional wager by placing one or more wagering devices in one or more of said first and second additional wager zones corresponding to a predicted color of an initial hand of two cards dealt to the player placing said first additional wager;

f) having at least one player place a second additional wager by placing one or more wagering devices in said third additional wager zone, wherein said second additional wager corresponds to a five-card poker hand comprising said initial hand of two cards dealt to the player placing said second additional wager and three cards dealt as community cards;

g) dealing a first card to each player and to the dealer;

h) dealing a second card to each player;

i) dealing three community cards;

j) determining a color of a first card and a second card dealt to the player placing said first additional wager;

k) determining a rank of said five-card poker hand of the player placing said second additional wager;

l) collecting an amount of said first additional wager if said first card and said second card dealt to the player placing said first additional wager are not of a same color or if said first card and said second card are of a same color but said same color is not said predicted color;

m) paying a predetermined multiple of said amount of said first additional wager if said first card and said second card dealt to the player placing said first additional wager are of a same color and said same color is said predicted color;

n) paying or collecting a predetermined multiple of an amount of said second additional wager based on said rank of said five-card poker hand of said player placing said second additional wager;

o) dealing a second card to the dealer; and p) completing the blackjack game according to conventional rules of blackjack play.

2. The method according to claim 1, wherein the step of dealing three community cards further comprises the step of dealing three community cards face up in a central location with respect to all players and the dealer.

3. The method according to claim 1, wherein the step of determining a rank of said five-card poker hand of the player placing said second additional wager further comprises the step of selecting said rank from the group consisting of royal flush, straight flush, four of a kind, full house, flush, straight, three of a kind, two pair, pair and no hand.

4. The method according to claim 1, wherein said first color is black and said second color is red.

5. The method according to claim 1, wherein the step of paying a predetermined multiple of said amount of said first additional wager further comprises paying a greater predetermined multiple of said amount of said first additional wager if said first card and said second card dealt to the player placing said first additional wager are of a same suit.

* * * * *